US008393880B2

(12) United States Patent
Vidal

(10) Patent No.: US 8,393,880 B2
(45) Date of Patent: Mar. 12, 2013

(54) PERISTALTIC PUMP

(76) Inventor: Lucien Vidal, Latresne (FR)

( * ) Notice: Subject to any disclaimer, the term of this patent is extended or adjusted under 35 U.S.C. 154(b) by 248 days.

(21) Appl. No.: 12/812,122

(22) PCT Filed: Jan. 9, 2009

(86) PCT No.: PCT/FR2009/050032

§ 371 (c)(1),
(2), (4) Date: Aug. 31, 2010

(87) PCT Pub. No.: WO2009/092948

PCT Pub. Date: Jul. 30, 2009

(65) Prior Publication Data

US 2010/0316516 A1 Dec. 16, 2010

(30) Foreign Application Priority Data

Jan. 11, 2008 (FR) ..... 08 00173

(51) Int. Cl.
*F04B 43/12* (2006.01)
*F04B 43/08* (2006.01)
*F04B 45/06* (2006.01)

(52) U.S. Cl. ..... 417/477.8; 417/477.1; 417/477.3

(58) Field of Classification Search ..... 417/477, 417/477.1, 477.3, 477.5, 477.6, 477.8, 477.13, 417/477.131

See application file for complete search history.

(56) References Cited

U.S. PATENT DOCUMENTS

| | | | | |
|---|---|---|---|---|
| 922,205 | A * | 5/1909 | Still | 417/61 |
| 3,421,447 | A * | 1/1969 | Idoine et al. | 417/477.6 |
| 4,492,538 | A * | 1/1985 | Iwata | 417/477.5 |
| 6,168,397 | B1 * | 1/2001 | Iwata | 417/477.12 |
| 6,918,748 | B2 * | 7/2005 | Miyazawa | 417/410.1 |

FOREIGN PATENT DOCUMENTS

| | | |
|---|---|---|
| DE | 2040034 | 2/1972 |
| EP | 0 075 020 | 3/1983 |
| WO | WO 2005/115884 | 12/2005 |

OTHER PUBLICATIONS

International Search Report dated Feb. 12, 2010.

* cited by examiner

*Primary Examiner* — Charles Freay
*Assistant Examiner* — Ryan Gatzemeyer
(74) *Attorney, Agent, or Firm* — RatnerPrestia

(57) ABSTRACT

The invention concerns an improved peristaltic pump including at least one elastically flattenable tube and at least two assemblies of two pressing elements placed opposite each other, each of said assemblies being configured to compress the tube at a different point from the pump. These two pressing elements of a single assembly are placed on either side of the tube, at least one of the pressing elements of this single assembly is mobile such that the distance separating the pressing elements of the single assembly is adjustable, to allow the pressing members to be placed in a rest position, in which the tube is not compressed by the pressing elements, or to allow the pressing elements to be placed in a position compressing the tube. Advantageously, the adjustment is made automatically when the peristaltic pump or pumping is started or stopped.

8 Claims, 5 Drawing Sheets

Fig. 8
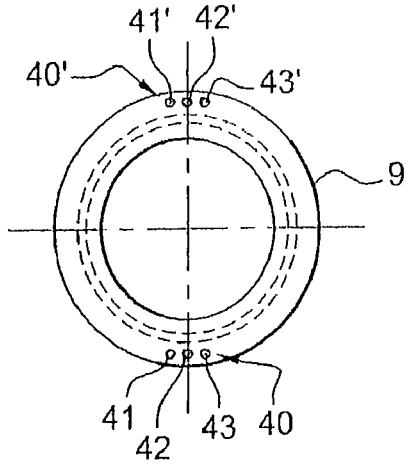
Fig. 9
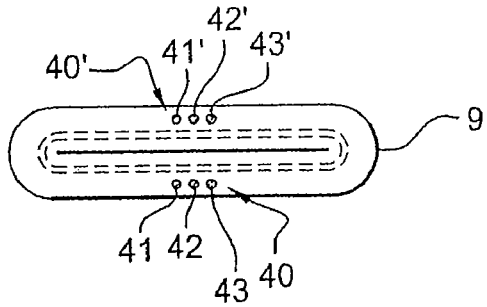
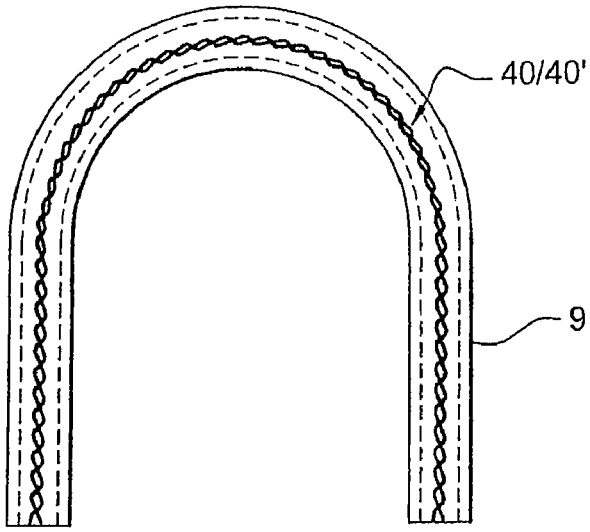
Fig. 10

PERISTALTIC PUMP

This application claims priority of PCT International Application No. PCT/FR2009/050032 filed on Jan. 9, 2009. The contents of which are incorporated herein by reference.

FIELD OF THE INVENTION

The invention concerns a peristaltic pump, and in particular a peristaltic pump with a tube compressed by at least two sets of pressing elements.

Such pumps are known for the pumping of liquid, viscous and/or granular products such as concrete, for instance.

BACKGROUND

These pumps comprise two sets of rollers, radial and opposite with respect to the rotor supporting and rotating these sets of rollers. In each set of rollers, two rollers are linked and are separated from each other by a width such that the two walls of the tube are in contact and sufficiently compressed to ensure the tube's tightness during pumping.

Peristaltic pumps use an elastic elastomer tube that is relatively expensive, therefore it is important to ensure that this has a maximum useful life.

FIGS. 1 to 3 show such a peristaltic pump 1 according to the prior state of the art. This pump comprises a rotor 2 fixed on a drive shaft 3. Fixed on this rotor 2 are two symmetrically opposed sets 4, 5 of two rollers 6, 7 rotationally mobile around their longitudinal axis 8.

The two rollers 6, 7 of each set 4, 5 are positioned on either side of the tube 9 of the pump 1 and separated by a width e substantially equal to or less than the double width of walls 10, 11 of the tube 9, so as to ensure tightness in line with the compression of the tube 9.

When the sets 4, 5 of rollers move from the inlet 12 of the pump 1 towards its outlet 13, by the rotation of the rotor, the compressed portion of tube 9 reverts to its original cylindrical shape after the passage of these sets of rollers.

Through the movement, or rotation, of the sets 4, 5 of rollers, the product contained in the tube 9 is drawn in at the inlet 12 of pump 1 and ejected at the outlet 13. The continuous rotation of rotor 2 consequently ensures a pumped flow of the product drawn in at the inlet 12 and then ejected at the outlet 13.

The pumped flow is naturally proportional to the rotational speed of the rotor 2 and to the internal cross-section of the tube 9. The rotation of the drive shaft 3 of rotor 2 of pump 1 is carried out by a motor, not shown.

The rollers 6, 7 of each set 4, 5 are cylindrical and radial cylindrical rollers 14 and axial cylindrical rollers 15 fixed on the rotor 2 guide the tube 9 and keep it in a centered position on the rotor 2.

However, this pump 1 presents a number of drawbacks.

Firstly, it is noted that the axial cylindrical rollers 15 tend to embed themselves laterally at 16 in tube 9 under the latter's tension, since these rollers 15 only bear against one point. As a result, they deform the cylindricity of this tube 9 and reduce its suction capacity.

In addition, a cumbersome retention frame 17 is required to avoid having the tube 9 break away outwards.

In effect, it can be seen that, when these sets 4, 5 of rollers rotate, a traction force is applied on the part of the tube 9 located upstream of these sets 4, 5, which therefore tends to be elongated under this force, thus causing buckling of the part of the tube 9 located downstream of these sets 4, 5, which must therefore be held by this external frame 17.

In addition, the compression of the tube 9 by cylindrical rollers 6, 7 produces a variable linear speed $V_1$, $V_2$, $V_3$ over their line of contact with the wall of tube 9, thus creating sliding between this latter and the rollers as a result causing wearing of the external wall of the tube and also heating of the latter that is harmful to the life of the tube 9.

Also, when the sets 4, 5 of cylindrical rollers arrive in front of the tube 9 to compress it during the rotation of the rotor, the sharp edge 18 located at the end of each roller 6, 7 strikes the external wall of the tube 9 and damages it, as a result also reducing the life of the tube 9.

Additionally, when the pump 1 is not utilized, it can remain stopped for a variable length of time, from a few hours to several months. The tube 9 therefore remains compressed by at least one of the two sets 4, 5 of rollers throughout the whole period during which pump 1 is not used. This can therefore lead to a permanent deformation of the elastomer of the tube 9, reducing the suction capacity of this tube 9 very substantially as a result.

It can even result in a decrease in the tube's suction capacity such that pump 1 is no longer able to pump and move any product.

Moreover, the force for compressing the tube 9 by the rollers 6, 7 spaced by width e must be the force required to ensure tightness during the pumping of the product at the maximum pressure that may be used. Because of this, the elastomer of the tube 9 is always subjected to a maximum deformation, not necessary when the pumping pressure is less.

Lastly, during the rotation of rotor 2, when one of the sets 4, 5 of rollers leaves contact with the tube 9 near the outlet 13 of pump 1, the two rollers 6, 7 are no longer driven by their friction on tube 9 and they therefore stop turning. Also when, after a certain rotation of rotor 2, these rollers 6, 7 arrive at the inlet 12 of pump 1, they come into contact with the external wall of tube 9 with a zero rotational speed and therefore abruptly start rotating. This results in damage to the external wall of tube 9 in line with the two impacts caused by the two rollers 6, 7, thus reducing the life of said tube 9.

SUMMARY OF THE INVENTION

The objective of this invention is therefore to propose a peristaltic pump, simple in its design and method of operation, allowing the drawbacks of pumps according to the state of the art to be eliminated.

To this end, the invention concerns a peristaltic pump comprising at least one elastically flattenable tube and at least two assemblies of two pressing elements placed opposite each other, each of said assemblies being intended to compress the tube at a different point of the pump.

According to the invention, the two pressing elements of a single assembly being placed on either side of the tube, at least one of the pressing elements of said single assembly is mobile such that the distance separating the pressing elements of this single assembly is adjustable, wherever said point of the pump is where said assembly of pressing elements is intended to compress said tube, to allow the pressing elements to be placed in a rest position, in which the tube is not compressed by these pressing elements, or in a position compressing said tube.

In different particular embodiments of this peristaltic pump, each having its specific advantages and capable of numerous possible technical combinations:

- at least the pressing elements placed on a same first side of this tube are controlled by at least one actuator able to move these pressing elements between a rest position, where the pressing elements are set back from the pressing elements placed on the other side of the tube without pressing the tube, and a position referred to as the tube compression position, this or these actuators automatically move the pressing elements towards the tube compression position when the peristaltic pump or pumping is started, and conversely towards the rest position when the peristaltic pump or pumping is stopped so as to release said tube, In a particular design version of the peristaltic pump, it is equipped with a hydraulic system that powers the rotor's drive motor.

A bypass of this hydraulic system by a specific hydraulic distributor enables control of the actuator or actuators made up of one or more hydraulic jacks.

When the peristaltic pump, and therefore the hydraulic system, is stopped the jack or jacks are no longer pressurized and the tube is released.

When the peristaltic pump is started, the hydraulic system is pressurized and the specific distributor operates the jack or jacks that compress the tube.

In an alternative embodiment, the automatic movement of the actuator or actuators only occurs when pumping is started, i.e. when the operator decides to actually pump the material by activating a means of control that pressurizes the hydraulic system simultaneously operating the rotor's drive motor and the actuator or actuators, as described above.

In this way damage to the tube when the pump is not working is avoided.

at least one of the pressing elements placed on a same side of the tube is mobile with respect to other pressing elements placed on the same side of the tube, Said at least one pressing element mobile with respect to the others allows, for example, a temporary movement of this pressing element in order to facilitate the passage in the tube of a material element likely to be otherwise blocked by these pressing elements fixed in place, as a result blocking the rotation of the peristaltic pump.

This movement can be caused by the walls of the tube moving apart temporarily on the passage of this material element, the pressing element just following the movement of the wall with which it is in contact.

the compression force applied by the pressing elements on the tube in the compression position is proportional to the pumping pressure so as to adapt the compression force in order to preserve tightness, In other words, the compression force applied by the pressing elements on the tube in the compression position is proportional to the motor torque of the rotor bearing the pressing elements and of this rotor's drive shaft.

the tube is held in place and centered in the body of the pump by fixed or mobile twin wheels, each of these twin wheels comprising a recess able to receive and guide said tube, These twin wheels have an inner recess with a diameter substantially equal to the external diameter of the tube. The mobile twin wheels make it possible to follow the tube as it moves.

at least some of said pressing elements being rotationally mobile rollers mounted radially on a rotor and the tube substantially forming a U in the pump, the pump comprises a spacer with a thickness equal to, or substantially equal to, the thickness of the compressed tube, this spacer being placed between the arms of this U in the pump so as to allow said rollers to continue to be rotated when said rollers are no longer in contact with said tube during the rotation of this rotor, "The tube substantially forming a U" means that the tube has a semi-circular or C shape. The spacer is placed between these arms so as to form a substantially continuous driving surface for the rollers in order to keep them rotating. This thus avoids having the rollers strike the tube with a zero rotation speed and knock against the tube, which could lead to it being weakened.

The two roller assemblies are preferably mounted radially opposite each other so as to transport the largest possible quantity of material that is liquid or consists of particles or grains, such as concrete.

the pressing elements are conically-shaped mobile rollers rotating around their longitudinal axis, the rollers comprise a rounded end, Alternatively, it is possible for the pressing elements of a same assembly not to be identical.

Thus, purely for purposes of illustration, a single pressing element may be mobile so as to allow the distance separating these pressing elements of a same assembly to be adjusted, the other pressing element being fixed and formed of a fixed wall, preferably flat.

This fixed wall may be formed by the frame of the peristaltic pump's body, for example.

Thus, when the peristaltic pump is in operation, the mobile pressing element, for example a roller, is moved to compress the tube against the fixed wall so as to cause tightness.

Advantageously, the surface of this fixed wall intended to receive the tube to be compressed can in addition comprise an adhesive coating to prevent any longitudinal sliding of this tube when it is compressed. This adhesive coating can be formed, for instance, of an elastomer strip.

the tube comprises, in its thickness, at least one layer of one or more cables placed over the primary winding diameter.

BRIEF DESCRIPTION OF THE DRAWINGS

In different possible embodiments, the invention will be described in more detail with reference to the drawings included in an appendix, in which:

FIG. 8 is a cross-section view of the tube of the pump in FIG. 4, this tube being strengthened by 2 layers of several cables FIG. 9 shows the tube in FIG. 8 in the compression position;

FIG. 10 is a top view of the tube in FIG. 8;

DETAILED DESCRIPTION

Figure 1:
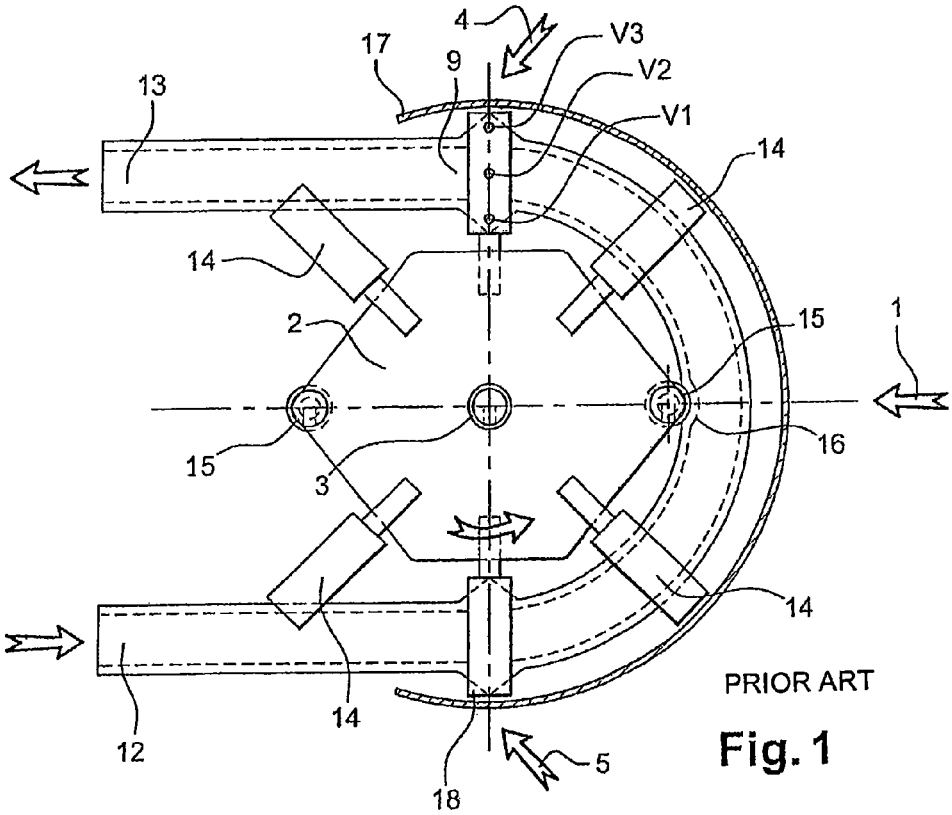
PRIOR ART Fig. 1
FIG. 1 is a partial view in cross-section of a peristaltic pump according to the prior state of the art.
Figure 2:
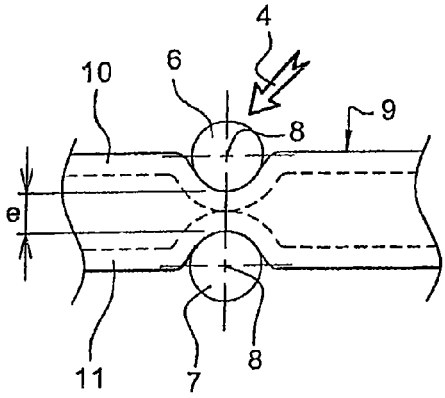
Fig. 2 PRIOR ART
FIG. 2 is a schematic representation of a fixed set of rollers for compressing the tube of the pump in FIG. 1.
Figure 3:
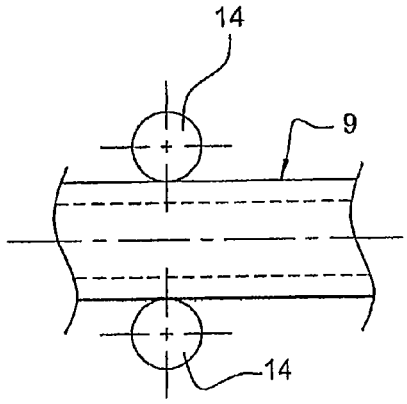
Fig. 3 PRIOR ART
FIG. 3 is a schematic representation of cylindrical rollers guiding the tube of the pump in FIG. 1.
Figure 4:
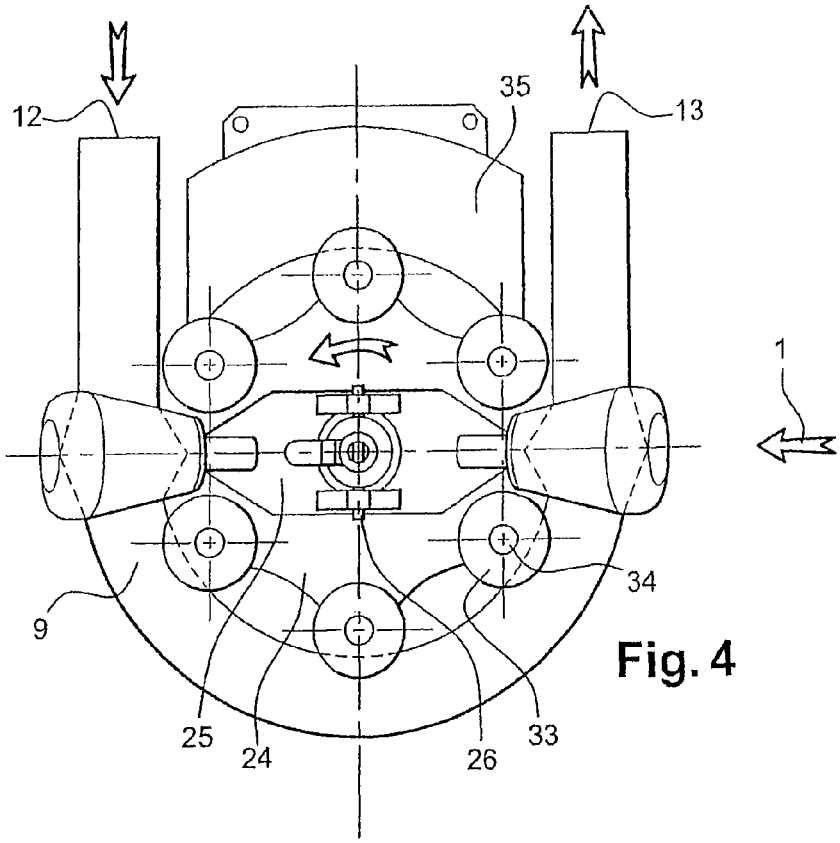
FIG. 4 is a schematic representation of a partial top view of a peristaltic pump according to a particular embodiment of the invention.
Figure 5:
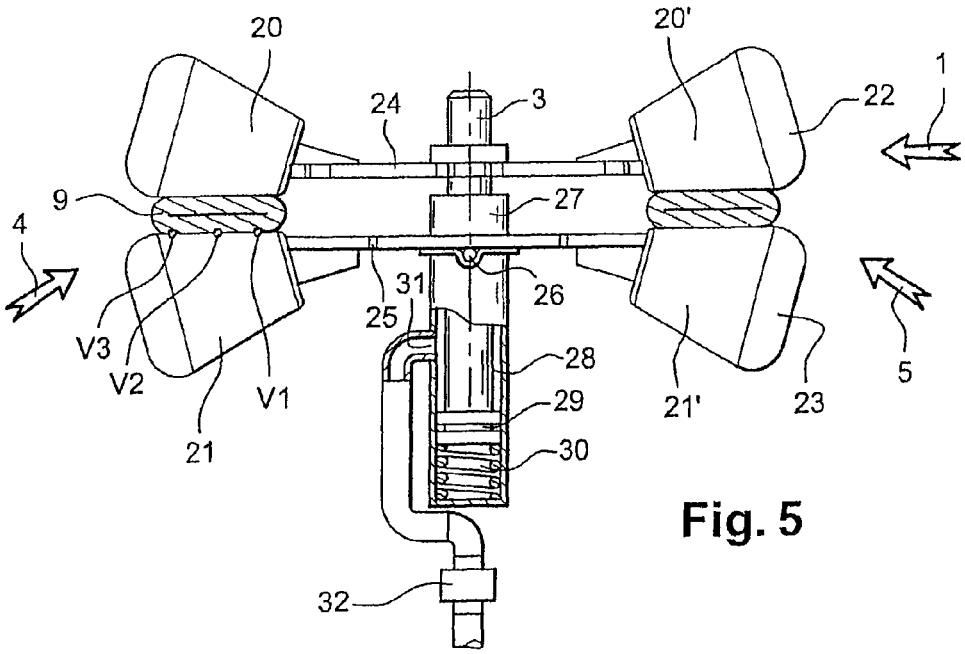
FIG. 5 is a schematic representation of a partial cross-section and front view of the pump in FIG. 4, the pressing element assemblies being in compression position for compressing the tube.
Figure 6:
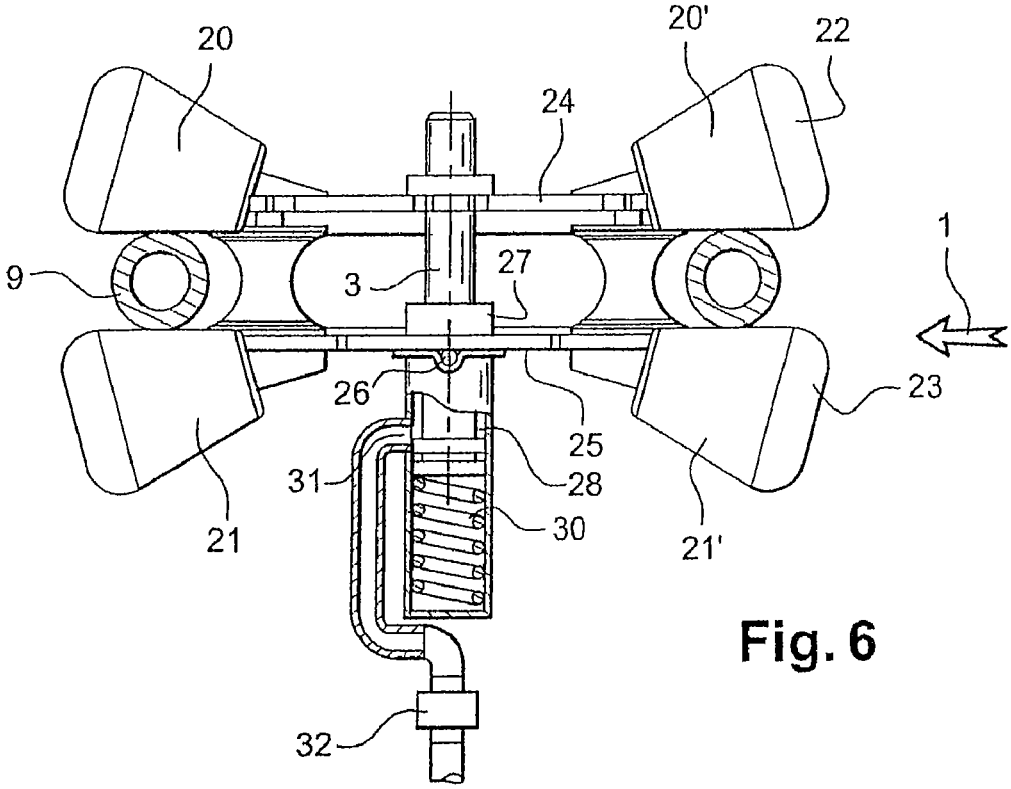
FIG. 6 is a schematic representation of a partial cross-section and front view of the pump in FIG. 4, the pressing element assemblies being in the rest position.
Figure 7:
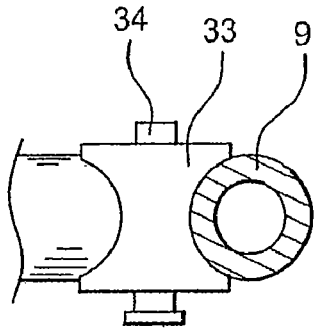
FIG. 7 is a schematic representation of a particular view of a twin wheels retaining the tube of the pump in FIG. 4.

FIGS. 4 and 7 are schematic representations of a peristaltic pump according to a particular embodiment of the invention. This pump 1 having been realized by adapting a pump according to the prior state of the art as described in FIGS. 1 to 3 in accordance with the invention, the elements identified in FIGS. 4 to 7 by the same references as in FIGS. 1 to 3, representing the same objects.

The two sets 4, 5 of rollers diametrically opposite with respect to the rotor's rotational axis each comprise two rollers 20, 20', 21, 21' having a suitably angled conical shape allowing sliding between these rollers and the tube to be reduced, or even eliminated, which improves the latter's lifespan.

These conical rollers 20, 20', 21, 21' each have a rounded end 22, 23 so that they gradually come into contact when they arrive rotating at the part of the tube placed near the inlet 12, thus avoiding superficial tearing of the external wall of tube 9.

Rotor 2 comprises, firstly, a fixed flange 24 driven by drive shaft 3, itself rotated by a motor, not shown.

This rotor comprises, secondly, a flange 25 likely to pivot around an axle 26, itself linked to a sliding ring 27 on drive shaft 3 and driven rotationally through sliding keying by said shaft 3.

This ring 27 comprises a chamber 28 for receiving a hydraulic fluid and, with the piston 29 itself linked to axle 3, forms an actuator jack.

At rest, this actuator jack is made to move downwards by the spring 30 pressing on the piston 29 itself linked to the axle 3, and consequently the flange 25 linked to the ring 27 is therefore made to move downwards and the tube 9 is not compressed.

If a pressurized fluid is introduced into the chamber 28 through the aperture 31, itself fed by a revolving joint 32, the sliding ring 27 and, as a result, the flange 25 are moved in the opposite direction, i.e. upwards, by the actuator jack.

Consequently, if the fluid is pressurized, the mobile flange 25 is moved and the two rollers 21, 21' linked to this flange compress the tube 9 against the rollers 20, 20' mounted on the fixed flange 24. The tube 9 is therefore compressed and said tube's tightness is ensured.

The compression force of tube 9 will be proportional to the pressure of the fluid entering the chamber 28.

This pressure of the fluid may be proportional to the pumping pressure of the product and thus ensure the required tightness corresponding to the pumping pressure. The elastomer of the tube 9 will only be called upon as much as necessary, thus improving its life.

The powering of the shaft 3, and therefore of the two flanges 24, 25, is performed by a hydraulic transmission. The rotational motor torque of the shaft 3 is proportional to the pumping pressure of the product.

The pressure of the powering hydraulic system will itself be proportional to the motor torque, thus to the pumping pressure of the product.

Therefore, if the actuator jack is powered by this hydraulic pressure, it will exert a compression force on the tube 9 proportional to the pumping pressure.

Since the flange 25 is free to pivot on its axle 26, and slide on the shaft 3, either one of rollers 21, 21' may be raised independently if it should encounter an aggregate blocked in the tube 9, thus avoiding the aggregate damaging or perforating the tube 9.

It is noted that if, when the peristaltic pump's motor is started or pumping begins, pressurized fluid is sent into the chamber 28, the two rollers 21, 21' compress the tube 9 and thus ensure the tightness required for pumping the product.

Conversely, when the peristaltic pump's motor is stopped or pumping ceases, no more pressurized fluid is sent into the chamber 28, the spring 30 will move the mobile flange 25 in the opposite direction and the two corresponding rollers 21, 21' will release the tube 9, which will therefore not be compressed while the pump 1 is stopped, thus avoiding permanent deformation of the elastomer of the tube 9. In this way, the lifespan and suction capacity of this tube are improved significantly.

If pump 1 is arranged in a substantially vertical position, as shown in FIG. 6, it seems that the return spring 30 can be eliminated. In effect, the mobile flange 25 can descend as a result of gravity when the pressurized fluid is no longer injected.

In FIGS. 4 and 6 and the cross-section view in FIG. 7, it is noted that the uncompressed part of the tube 9 located between the two sets 4, 5 of rollers is held and centered by twin wheels 33 turning around their axle 34, and positioned on the fixed flange 24. These twin wheels 33 can also be moved axially along their axle 34 to follow the axial movements of the tube 9, when the sets 4, 5 of rollers are placed in their rest position or compression position.

The internal diameter of these twin wheels 33 is substantially equal to the external diameter of the tube 9 so as to help it, in addition to its own elasticity, regain its cylindrical shape and thus boost its suction power.

In this context, the twin wheels 33 advantageously replace the axial rollers 15 and radial rollers 14 of a pump according to the state of the art (FIG. 1).

A spacer 35 is fixed between the inlet 12 and outlet 13 of the tube 9, in the plane of said tube's axis. It has a thickness substantially equal to the thickness of the compressed tube 9 so as to be able to keep the rollers rotating without the mobile flange 25 having to be moved.

Thus, when one of the two sets 4, 5 of rollers leaves the tube 9 at the outlet 13, the rollers 20, 20', 21, 21' continue to press on this spacer 35 and therefore continue to rotate.

Also, when said rollers come into contact, at the inlet 12 of the tube 9, they are already rotating and do not alter the external wall of said tube.

Another example of realization according to the invention, but not shown, can be formed of two symmetrically opposite assemblies of two sets of mobile flanges 25, each equipped with a chamber 28 and a piston 29 forming an actuator jack.

Another example of realization of the invention, not shown, can be realized with more than two sets 4, 5 of rollers.

Other examples of realizations according to the invention, not shown, can be realized by using pneumatic or hydraulic electric means that can exert a compression and withdrawal force, replacing the chamber 28 and piston 29 forming an actuator jack.

Advantageously, the tube 9 will be reinforced by a layer 40 made of one or more cables 41, 42, 43 arranged over said tube's primary winding diameter. This layer 40 may advantageously be supported by a second layer 41, itself made from one or more cables 41', 42', 43', and symmetrically opposite to said first layer.

This longitudinal layer makes it possible to retain a constant length for the tube 9, whatever the traction force exerted by the sets 4, 5 of rollers, and thus keep the tube centered on the sets of rollers, which allows the burdensome housing 17 utilized in pumps according to the state of the art to be eliminated.

Figure 11:
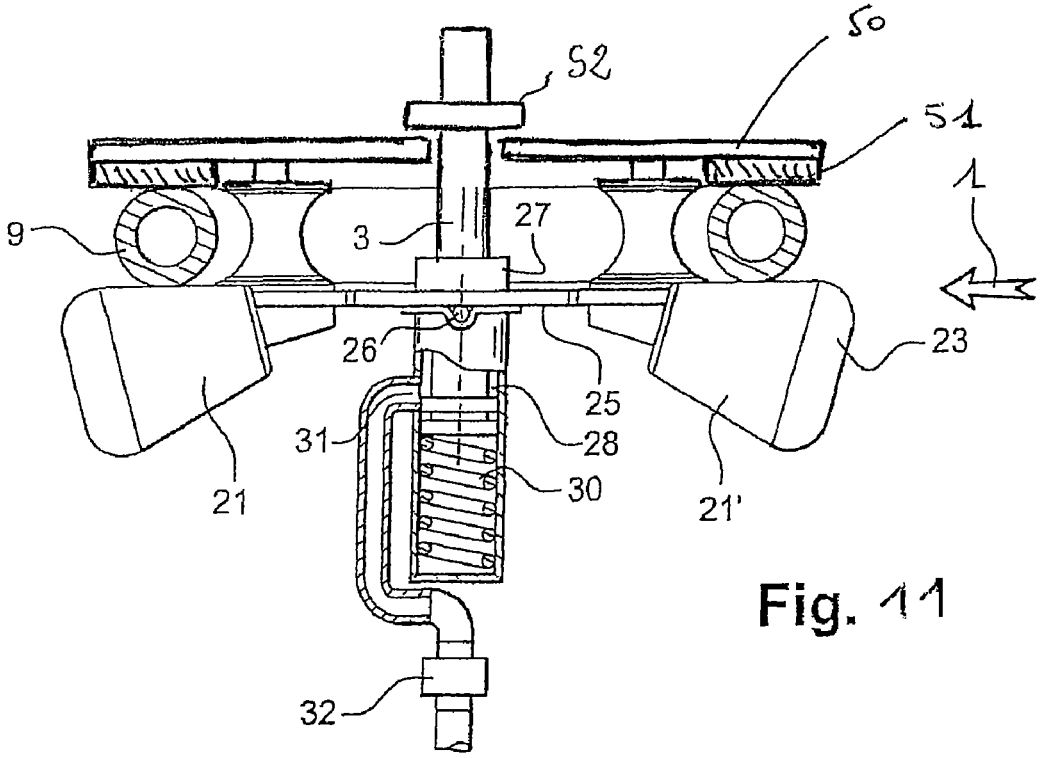
FIG. 11 is a schematic representation of a cross-section and front view of a peristaltic pump according to another embodiment of the invention, with fixed wall.

FIG. 11 is a schematic representation of a peristaltic pump according to another embodiment of the invention. The elements in FIG. 11 bearing the same references as the elements in FIG. 6 represent the same objects, which will consequently not be described again. The peristaltic pump in FIG. 11 differs from that in FIG. 6 in that the pressing elements 21, 21', 50 of a same assembly are not identical.

The pressing element 21, 21' located below the tube 9 in each assembly is a mobile roller, while the pressing elements placed above this tube 9 are made of a single fixed flat wall 50.

This fixed wall 50 further comprises an adhesive coating 51 intended to receive the tube 9 so as to prevent any longitudinal sliding of the latter when the tube is compressed by the pressing element assemblies 21, 21', 50.

The drive shaft 3 crosses the fixed wall 50 and is rotationally mobile with respect to it. A stop 52 absorbs the compression forces of the tube 9.

This peristaltic pump further comprises a spacer (not shown) with a thickness equal to, or substantially equal to, the thickness of the compressed tube 9, this spacer being placed between the arms of said U in the peristaltic pump to allow the rollers 21, 21' placed under the tube 9 to continue being rotated when these rollers 21, 21' are no longer in contact with said tube 9 during the rotation of the rotor 2.

The invention claimed is:

1. A peristaltic pump comprising at least one elastically flattenable tube and at least two assemblies of two pressing elements placed opposite each other, each of said assemblies being configured to compress said tube at a different point of said pump, wherein said two pressing elements of a single assembly are placed on either side of said tube, at least one of the pressing elements of said single assembly is mobile such that a distance separating said pressing elements of said single assembly is adjustable, from said point of the pump where said assembly of pressing elements is configured to compress said tube, to allow said pressing elements to be placed in a rest position, in which said tube is not compressed by said pressing elements, or a compression position to allow said pressing elements to be placed in a position compressing said tube, wherein at least the pressing elements placed on a first side of the tube are controlled by at least one actuator able to move said pressing elements on the first side of the tube between the rest position, where said pressing elements on the first side of the tube are set back from the pressing elements placed on another side of said tube without pressing the tube, and a position referred to as the compression position of the tube, wherein said actuator automatically moves said pressing elements towards said compression position of the tube when said peristaltic pump or pumping is started, and conversely towards the rest position when said peristaltic pump or pumping is stopped so as to release said tube.

2. A pump according to claim 1, wherein at least one of the pressing elements placed on a same side of said tube is mobile with respect to other pressing elements placed on the same side of the tube.

3. A pump according to claim 1, wherein a compression force applied by said pressing elements on said tube in the compression position is proportional to the pumping pressure so as to adapt the compression force in order to tightly compress the tube.

4. A pump according to claim 1, wherein said tube is held in place and centered in a body of said pump by fixed or mobile twin wheels, each of said twin wheels including a recess configured to receive and guide said tube.

5. A pump according to claim 1, wherein at least one of said pressing elements includes rotationally mobile rollers mounted radially on a rotor and the tube substantially forming a U in said pump, the pump including a spacer with a thickness equal to, or substantially equal to, a thickness of the compressed tube, the spacer being placed between respective arms of said U in said pump so as to allow said rollers to continue to be rotated when said rollers are no longer in contact with said tube during the rotation of said rotor.

6. A pump according to claim 1, wherein each of said pressing elements is a conically-shaped mobile roller rotating around a respective longitudinal axis.

7. A pump according to claim 1, wherein each of said rollers includes a rounded end.

8. A pump according to claim 1, wherein said tube has a thickness, and includes at least one layer of one or more cables placed over a primary winding diameter.

* * * * *

UNITED STATES PATENT AND TRADEMARK OFFICE

CERTIFICATE OF CORRECTION

PATENT NO. : 8,393,880 B2
APPLICATION NO. : 12/812122
DATED : March 12, 2013
INVENTOR(S) : Lucien Vidal It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 297 days.

Signed and Sealed this
First Day of September, 2015

Michelle K. Lee

Michelle K. Lee
*Director of the United States Patent and Trademark Office*